US011697149B2

(12) United States Patent
Kubiak

(10) Patent No.: US 11,697,149 B2
(45) Date of Patent: Jul. 11, 2023

(54) STAMPING PRESS FORMING OF OUTER DIAMETER HELICAL SPLINES

(71) Applicant: Magna Powertrain, Inc., Concord (CA)

(72) Inventor: Ronald Kubiak, Sterling Heights, MI (US)

(73) Assignee: MAGNA POWERTRAIN, INC., Concord (CA)

( * ) Notice: Subject to any disclaimer, the term of this patent is extended or adjusted under 35 U.S.C. 154(b) by 0 days.

(21) Appl. No.: 17/725,691

(22) Filed: Apr. 21, 2022

(65) Prior Publication Data

US 2022/0339692 A1 Oct. 27, 2022

Related U.S. Application Data

(60) Provisional application No. 63/179,016, filed on Apr. 23, 2021.

(51) Int. Cl.
*B21K 1/30* (2006.01)

(52) U.S. Cl.
CPC ..... *B21K 1/305* (2013.01)

(58) Field of Classification Search
CPC . B21K 1/305; B21K 1/30; B21K 1/28; B21K 1/32; B21J 5/12; B21J 9/02; B21H 3/02; B21H 3/04; B21H 3/06
See application file for complete search history.

(56) References Cited

U.S. PATENT DOCUMENTS 2,376,727 A * 5/1945 Schutte ..... B21H 3/042 72/100
4,770,572 A * 9/1988 Ohkawa ..... B22F 5/085 29/893.33
5,465,597 A * 11/1995 Bajraszewski ..... B21K 1/305 72/19.8

FOREIGN PATENT DOCUMENTS

| | | | |
|---|---|---|---|
| DE | 102017001211 | A1 | 8/2018 |
| JP | S5570426 | A | 5/1980 |
| JP | 2010023092 | A | 2/2010 |
| JP | 6304694 | A | 3/2016 |
| JP | 6785484 | A | 11/2021 |

* cited by examiner

*Primary Examiner* — Teresa M Ekiert
(74) *Attorney, Agent, or Firm* — Dickinson Wright PLLC

(57) ABSTRACT

A press assembly for forming outer helical splines on a blank includes an upper press shoe assembly and a die shoe assembly. The upper press shoe assembly includes an upper rotatable portion rotatable relative to an upper stationary portion. The lower portion includes a lower rotatable portion rotatable relative to a lower stationary portion. The unfinished blank is supported by the lower portion, and the upper portion is moveable into engagement with the blank. The upper rotatable portion joins with the lower rotatable portion for conjoint rotation relative to the upper and lower stationary portions via upper and lower helical meshes defined between the rotatable and stationary portions. The helical meshes convert downward force into rotation and translation of the blank into a spline forming die of the lower stationary portion to create the outer helical splines.

20 Claims, 9 Drawing Sheets

STAMPING PRESS FORMING OF OUTER DIAMETER HELICAL SPLINES

CROSS-REFERENCE TO RELATED APPLICATIONS

The present application claims the benefit of and priority to U.S. Provisional Patent Application No. 63/179,016, filed Apr. 23, 2021, the entire content of which is hereby incorporated by reference in its entirety.

FIELD OF THE INVENTION

The present disclosure is generally related to a method of producing a helical outer diameter splined component using a stamping press. The present disclosure is further related to a helical shaped punch and die tooling to form a helical outer diameter in a stamped component. The present disclosure is further related to using press force with helical shaped tooling to coordinate rotation of a punch into a die to form a helical outer diameter in a stamped component without the need for rotating press tooling by external means.

BACKGROUND OF THE INVENTION

This section provides background information related to the present disclosure which is not necessarily prior art.

Opposed to straight tooth forms, helical gear or spline tooth forms have a non-parallel or inclined arrangement relative to the axis of rotation of the gear. Due to the non-parallel tooth angle, the manufacturing of helical tooth forms has an increased complexity and includes higher manufacturing costs, driven by time to produce and capital equipment required. Current production of helical gear forms is achieved by cutting or grinding the tooth form. One example of cutting is hobbing where a disc requiring helical teeth around the entire outer diameter is rotated in steps. A hob forms teeth on a portion or sector of the overall diameter, so the part is rotated through several of these sectors until complete. This is a lengthy and costly process which also could require further finishing operations to achieve a final gear form. Other processes such as rolling are used for helical splines, but typically on solid shafts due to the compressive forces involved it would be difficult to implement on a disc shaped component.

In view of the above, a need exists to continue development of new and improved manufacturing processes for disc shaped components with an external helical tooth form. A solution needs to create an accurate and final geometry while producing a high volume of parts in a cost-efficient manner. It would also be beneficial to utilize existing stamping manufacturing equipment to reduce capital expense.

SUMMARY

It is an aspect of the present disclosure to provide a process capable of forming a disc with an external helical spline gear form using stamping press equipment.

It is an aspect of the present disclosure to provide a process where the final part geometry does not require additional finishing operations.

It is an aspect to transform the vertical press force into a rotational component during the process to accurately form the helical gear form.

It is a related aspect of the present disclosure to achieve the rotational tooling motion required to develop a helical tooth form without any external rotating driving means.

It is a related aspect of the present disclosure to utilize a press stripper as a drive plate.

It is a related aspect of the present disclosure to utilize forces from gas springs on the drive plate and in conjunction with helical gear form tooling to impart a rotation on the punch while forming the final part in the die.

It is a related aspect of the present disclosure to have a punch and die with a helical spline form with the same dimensional characteristics as the final part.

It is a related aspect of the present disclosure to achieve a final part geometry which includes a quality surface finish due to a smooth sheering across the helical tooth.

In accordance with these and other aspects, a press arrangement has been arranged to produce, in high volume, a disc shaped component with a helical tooth form on its outer diameter. This non limiting helical spline could also be considered a helical gear form on the external diameter of a circular part. The press will comprise an upper portion and a lower portion, each with tooling within these portions which will rotate during the stamping process while traveling vertically to punch the blank into a final form. The upper portion includes the upper die shoe and a stripper which has been configured to operate as a drive plate using a first helical gear interface to impart a rotational moment on the punch from a vertical load applied by gas springs. The lower die shoe retains a stationary die with a second helical interface. Internally to the second helical interface is a support structure which rotates in conjunction with the punch through drive pins or clamping forces through the blank. As press force is applied to the punch, the force is applied to a rotatable tooling and vertically traveling through and shearing the blank as the punch enters into the die. A synchronized indexing or rotation of the punch and lower support structure occurs driven by the helical interfaces which match the helical angle of the final part and a helical form is stamped on the outer diameter of the blank. As the press force is reduced, the rotated components reverse direction with the assistance of a lower gas spring and the final part is removed from the die when the press opens. No other mechanized driver (i.e. motor or mechanical linkage tied to press movement) is used to index or rotate the tooling.

In another aspect, a method for forming external helical spline features on a circular blank is provided, the method including the steps of: providing a lower die shoe assembly configured to receive a gear blank having an unfinished condition, the lower die shoe assembly including a lower stationary portion and a lower rotatable portion rotatable relative to the lower stationary portion; providing an upper punch shoe assembly configured to move relative toward the lower die shoe assembly, the upper punch shoe assembly including an upper stationary portion and an upper rotatable portion rotatable relative to the upper stationary portion; providing the gear blank between the upper punch shoe assembly and lower die shoe assembly and supporting the gear blank on the lower die shoe assembly; bringing the upper punch shoe assembly into contact with the gear blank; driving the upper rotatable portion downward relative to the upper stationary portion and rotating the upper rotatable portion relative to the upper stationary portion; driving the blank downward into to the lower stationary portion and rotating the blank relative to the lower stationary portion; in response thereto, forming an external helical spline on the blank with the lower stationary portion.

In one aspect, an upper helical mesh is defined between the upper stationary portion and the upper rotatable portion and a lower helical mesh is defined between the lower stationary portion and the lower rotatable portion, wherein an angle of the upper and lower helical mesh is the same.

In one aspect, an angle of the external helical spline matches the angle of the upper and lower helical mesh.

In one aspect, the upper rotatable portion includes external toothing, wherein the external toothing is received with internal toothing of the lower stationary portion when the upper rotatable portion is driven downward.

In one aspect, the upper rotatable portion engages the lower rotatable portion such that the upper rotatable portion and lower rotatable portion rotate together.

In one aspect, the upper stationary portion includes at least one alignment dowel extending therefrom, wherein the at least one alignment dowel is received in a corresponding alignment bore formed in the lower stationary portion.

In one aspect, the upper rotatable portion includes at least one drive pin extending downwardly therefrom, wherein the at least one drive pin is received in a corresponding drive pin bore of the lower rotatable portion.

In one aspect, the blank includes at least one aperture extending therethrough, wherein the at least one drive pin passes through the at least one aperture.

In one aspect the method includes fixing rotation of the upper rotatable portion to the lower rotatable portion prior to driving the blank downward.

In one aspect the method includes applying a downward press force on the upper rotatable portion and the upper stationary portion, wherein an upper helical mesh indexes the upper rotatable portion relative to the upper stationary portion to causes relative vertical and rotational movement between the upper rotatable portion and the upper stationary portion.

In one aspect the method includes counteracting the downward press force with an upwardly directed spring force applied to the lower rotatable portion.

In one aspect, the downwardly press force is applied to the upper stationary portion, through a bearing disposed between the upper stationary portion and the upper rotatable portion, and into the upper rotatable portion.

In one aspect, the upper stationary portion includes a first upper bearing plate and the upper rotatable portion includes a helical driven pressing plate, wherein a first lower bearing is disposed vertically between the helical driven pressing plate and the first upper bearing plate.

In one aspect, the upper rotatable portion further includes an upper bearing retainer and a first lower bearing plate, wherein the first lower bearing plate is fixed to the helical driven pressing plate and disposed between the first upper bearing plate and the helical driven pressing plate, a first upper bearing is disposed vertically between the upper bearing retainer and the first upper bearing plate, and the first lower bearing is disposed vertically between the first upper bearing plate and the first lower bearing plate.

In one aspect, the upper stationary portion includes a helical driver having first internal threads, and the upper rotatable portion includes a helical driven pressing plate having first external threads, wherein the first internal and first external threads engage to define a upper helical mesh; and, the lower stationary portion includes a helical spline forming die having second internal threads, and the lower rotatable portion includes a helical lower pad, wherein the second internal and second external threads engage to define a lower helical mesh.

In another aspect, a press assembly for defining external helical threads on a blank is provided, the press assembly including: a lower die shoe assembly configured to receive a gear blank having an unfinished condition, the lower die shoe assembly including a lower stationary portion and a lower rotatable portion rotatable relative to the lower stationary portion; an upper punch shoe assembly configured to move relative toward the lower die shoe assembly, the upper punch shoe assembly including an upper stationary portion and an upper rotatable portion rotatable relative to the lower stationary portion, wherein the upper punch shoe assembly is configured to engage the blank and shape the blank in combination with the lower die assembly; wherein the upper rotatable portion and lower rotatable portion are configured to engage each other in fixed relation for conjoint rotation; wherein the upper rotatable portion and lower rotatable portion are moveable downward relative to the upper and lower stationary portions, wherein the relative downward movement causes the conjoint rotation.

In one aspect, the upper stationary portion includes: a helical driver having first internal threads, and the upper rotatable portion includes a helical driven pressing plate having first external threads, wherein the first internal and first external threads engage to define an upper helical mesh; the lower stationary portion includes a helical spline forming die having second internal threads, and the lower rotatable portion includes a helical lower pad having second external threads, wherein the second internal and second external threads engage to define a lower helical mesh; and, the upper and lower helical mesh have the same angle.

In one aspect, the upper rotatable portion includes at least one drive pin extending therefrom, wherein the lower rotatable portion includes at least one drive pin bore corresponding to the at least one drive pin, wherein the drive pin bore receives the drive pin in response to downward movement of the upper rotatable portion to fix the upper and lower rotatable portion for conjoint rotation.

In one aspect, the helical drive pressing plate is moveable into the helical spline forming die.

In one aspect, the upper stationary portion includes a first upper bearing plate, wherein the upper rotatable portion further includes an upper bearing retainer and a first lower bearing plate, wherein the first upper bearing plate is disposed between the upper bearing retainer and the first lower bearing plate; the upper rotatable portion includes a helical driven pressing plate fixed to the first lower bearing plate, and the first lower bearing plate is disposed between the first lower bearing plate and the helical driven pressing plate; a first lower bearing is disposed vertically between the first upper bearing plate and the first lower bearing plate and a first upper bearing is disposed between the upper bearing retainer and the first upper bearing plate; the lower rotatable portion includes a helical lower pad fixed to a lower pressure pad; the stationary portion includes a lower bearing retainer fixed to an inner base plate; a second upper bearing is disposed between the lower bearing retainer and the lower pressure pad, and a second lower bearing is disposed between the lower pressure pad and the inner base plate.

BRIEF DESCRIPTION OF THE DRAWINGS

The drawings described herein are for illustrative purposes only of selected embodiments and are not intended to limit the scope of the present disclosure. The inventive concepts associated with the present disclosure will be more readily understood by reference to the following description in combination with the accompanying drawings wherein.

DETAILED DESCRIPTION

The press assembly, its components and its operating characteristics will now be described more fully with reference to the accompanying drawings.

Figure 1:
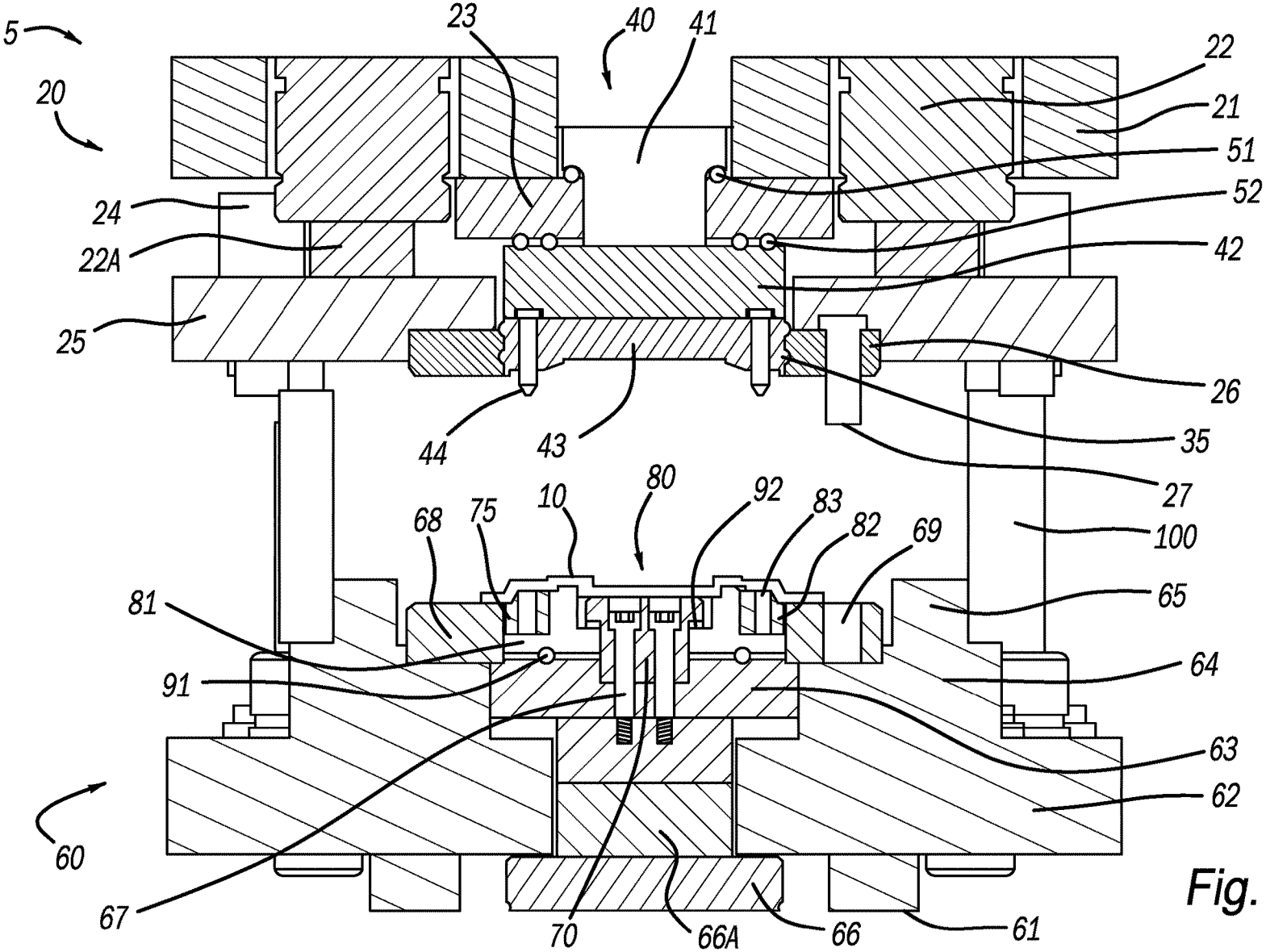
FIG. 1 is a sectional view of the press assembly showing the upper portion raised from the lower portion in a condition to receive the blank with the blank positioned in the press.

Referring to FIG. 1, press assembly 5 is positioned in its starting position where it is ready for receipt of blank 10. The press can be considered to be constructed of an upper portion and a lower portion, split at the point of where blank 10 is placed. The upper portion is a punch shoe with guide assembly 20. The lower portion is a lower die shoe assembly 60. Within the punch shoe with guide assembly 20, there is an upper rotating tooling assembly portion 40, which is allowed to rotate relative to the punch shoe assembly 20. Within the lower die shoe assembly 60, there is the lower rotating tooling assembly 80, which is allowed to rotate relative to the lower die shoe assembly 60. Operational characteristics will be described later to describe the motion, vertical and rotational, between each of these four main tooling assemblies to produce, from the blank 10, a plate with a helical tooth form on the outer diameter.

With particular attention to the upper portion of FIG. 1, The punch shoe with guide assembly 20 comprises two main structural plates, an upper die shoe 21 and a drive plate 25. Drive plate 25 can also be considered a stripper which in previous press arrangements is used to remove material that adheres to the punch. The upper die shoe 21 and the drive plate 25 are not linked together in vertical motion, but are aligned about the vertical axis via guide posts 100. A plurality of upper gas springs 22 are positioned in the upper die shoe 21 and remain in contact with the top surface of drive plate 25 with the face of piston 22A of upper gas spring 22. On the bottom portion of the upper die shoe 21, a pad bottoming block 24 and an upper bearing plate 23 is mounted in a fixed position to the upper die shoe 21. Helical driver 26 is mounted to drive plate 25 in a fixed relationship. A helical tooth form is formed into the inner diameter of helical driver 26 to provide the outside diameter of the upper helical mesh 35. This helical gear form has similar characteristics as the helical gear form of the final part 12. For instance, the helical angle will be the same, while the minor and major spline diameters will be adjusted accordingly for appropriate stamping operation. Also positioned in helical driver 26 are three setup alignment dowels 27 (see FIG. 3). These alignment dowels 27 will be used to ensure a concentric alignment between the helical driver 26 and the helical spline forming die 68 (of the lower die shoe assembly) during the setup of the press tooling.

The previously described upper bearing plate 23 is the structural basis of the upper rotating tooling assembly components 40. On the upper side of the upper bearing plate 23, an upper bearing retainer 41 is positioned. In between the upper bearing plate 23 and the upper bearing retainer 41, bearing 51 is located. This bearing 51 can be of any arrangement although in the figures it is shown as a multitude of ball bearings operating on grooves formed in both the upper bearing plate 23 and the upper bearing retainer 41. In a similar arrangement, bearing 52 is positioned between the upper bearing plate 23 and lower bearing plate 42. As previously described, the upper bearing plate 23 is a fixed component to upper die shoe 21. This allows the upper bearing retainer 41 and lower bearing plate 42, which are fixed to each other capturing bearings 51 and 52, to rotate about the vertical axis. Helical driven pressing plate 43 is also fixed to retainer 41 and bearing plate 42 with fasteners (not shown), allowing a combined rotational movement. Helical driven pressing plate 43 includes drive pins 44 which protrude from the lower side. On the outer diameter of the helical driven pressing plate 43, a helical spine form is provided, which is designed to mate to the helical spline form of the helical driver 26 to create the upper helical mesh 35. Further operational characteristics between the helical driver 26 and the helical driven pressing plate 43 will be further described later in the specification.

Now moving attention to the lower portion of FIG. 1, and with additional reference to FIG. 4, the components of the lower die shoe assembly 60 will be described. The main structural plate of the lower portion of the press, the lower die shoe 62 is supported by parallel supports 61 positioned below. The lower die shoe 62 is positioned about the vertical axis via guide posts 100. Guide posts 100 ensure alignment of the upper and lower portions of the press and extend from the lower die shoe assembly 60 to the upper die shoe 21. Attached to the lower die shoe 62 on the upper side is the base plate 64. Further attached to the upper side of the base plate 64 are multiple pad balancing blocks 65 arranged equally around base plate 64. Inward of the pad balancing blocks 65, the helical spline forming die 68 is positioned. Helical spline forming die 68 is fastened and fixed to the base plate 64. The parallel supports 61, lower die shoe 62, base plate 64, and pad balancing block 65 can be considered one monolithic component. Helical spline forming die 68, in three equal angular positions has a setup alignment bores 69. This bores 69 will receive setup alignment dowels 27 when the press is closed and be used for final concentric alignment between the helical driver 26 and helical spline forming die 68.

Still with respect to the lower portion of FIG. 1, the body of lower gas spring 66 is positioned and fixed in the center of the lower die shoe 62. Piston 66A of the lower gas spring 66 provides an upwards vertical force against the tooling as it is compressed, which supports the center portion of blank 10 and therefore final helical OD stamped part 12. The body of the lower gas spring 66 is fixed in position to the lower die shoe 62, but the piston 66A extends upwards relative to the body 66 and provides a force on lower die shoe 62. The piston 66A continually applies a force, although varying during stamping operation based on the position of lower die shoe 62 and inner base plate 63 so there is always contact with the inner base plate 63. Mounted above the inner base plate 63 with a plurality of fasteners 67 is the lower bearing retainer 70. Note that the lower gas spring 66, inner base plate 63 and lower bearing retainer 70 are fixed rotationally together as well as fixed rotationally to the lower die shoe 62 via an anti-rotation dowel 71 shown in FIG. 6. These three components (gas spring 66, inner base plate 63, and bearing retainer 70) are allowed to move vertically relative to the lower die shoe 62 and the base plate 64. Positioned between the inner base plate 63 and the lower bearing retainer 70 is the lower pressure pad 81. The lower pressure pad 81 is supported on the bottom by bearing 91 against the inner base plate 63 and above by bearing 92 against the lower bearing retainer 70. These bearings 91 and 92 can be of any arrangement although in the figures it is shown as a multitude of ball bearings for bearing 91 with operating on grooves formed in both the inner base plate 63 and lower pressure pad 81, while bearing 92 is shown as thrust washer. This bearing arrangement allows the lower pressure pad 81 to rotate about the lower bearing retainer 70. Helical lower pad 82 is fixed to the lower pressure pad 81 resulting in the helical lower pad 82 and lower pressure pad 81 to make up the components in the lower rotating assembly 80. The helical lower pad 82, at the outer diameter thereof, has a helical spline form which would mesh or mate with the inner spline form of the helical spline forming die 68 to create lower helical mesh 75. In one aspect, the lower pressure pad 81 is not threaded and defines a radial gap relative to the inner diameter of the spline forming die 68. The helical features of the helical spline forming die 68 are used to properly support the blank, particularly near the outer diameter, during the stamping process to ensure good shearing of the helical tooth feature. Piloting feature 85 (seen in cross-section of FIG. 8) on the helical spline forming die 68 is used to position blank 10. The helical spline forming die 68 also has a multitude of drive pin bores 83 which will receive the drive pin 44 of the upper portion of the press, with the drive pin also passing through aperture 13 of blank 10. Alternative methods to the use of drive pins 44 will be explained later in the specification.

Figure 2:
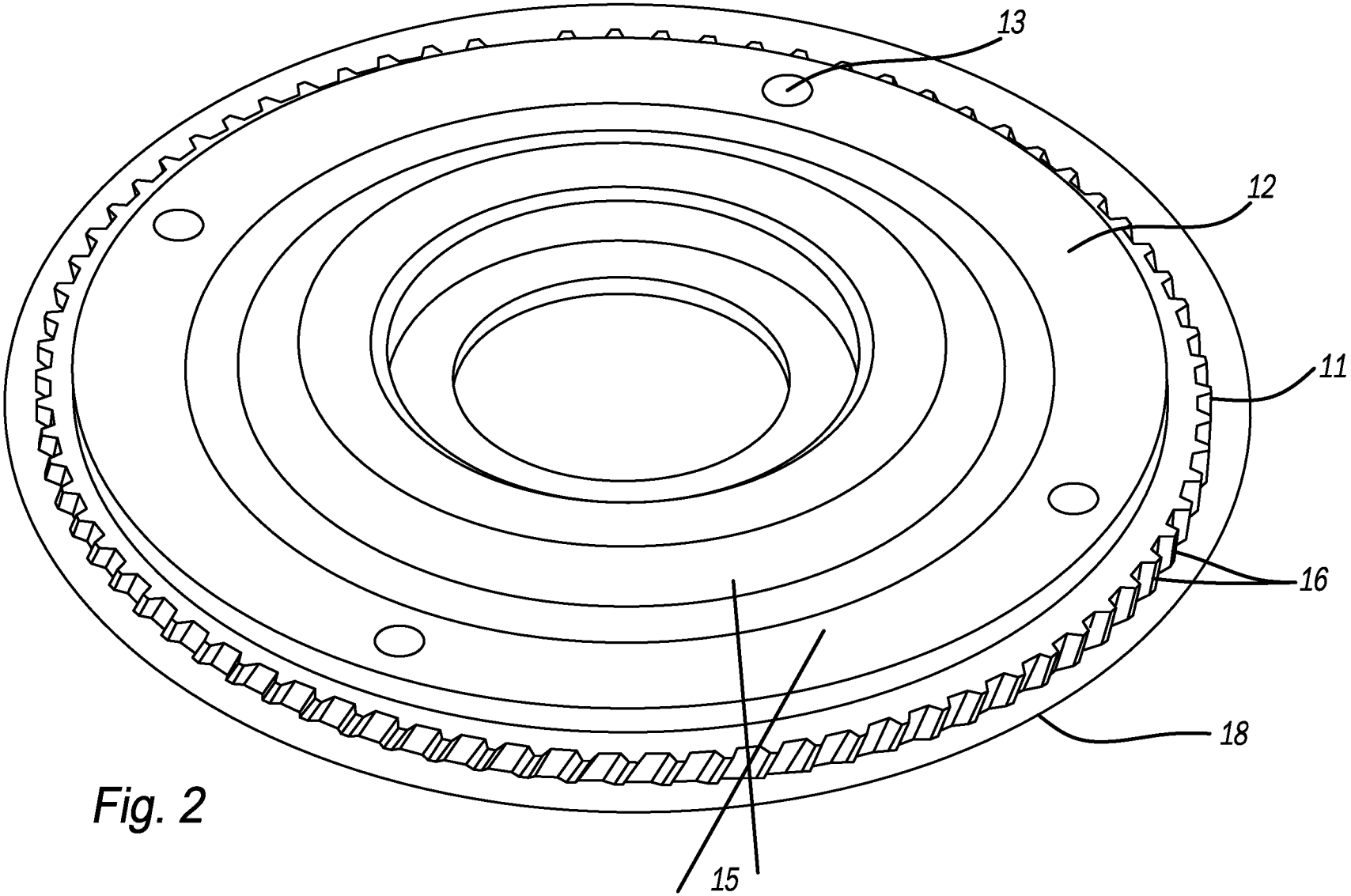
FIG. 2 is an example of a type of disc in its final form with an outer diameter helical spline which can be produced by the press in FIG. 1.

Referring to FIG. 2, the finished helical outer diameter stamped disc 12 is shown. In the manufacturing process described, blank 10 would begin with an overall larger diameter 18 with a thickness 16 on the outer portion same as the final part. The geometric features such as the central bore and apertures 13, as well as any differences in thickness or transitions may also be previously formed as the application requires. Finished part 12 will have a helical tooth spine portion 11 on the outer edge. This helical spline will have an angle 15 which is non-parallel to the central axis of the blank 10 and finished part 12 and is formed across the entire thickness 16 of the part. The helical spline angle 15 will be the same for each spline or tooth on the outer diameter. The helical spline angle 15 can vary dependent on application requirements. In this example the angle is approximately 30 degrees. The hand of the helix can be either left hand or right hand dependent on application requirements, but will be the same hand throughout a given finished part 12.

Figure 3:
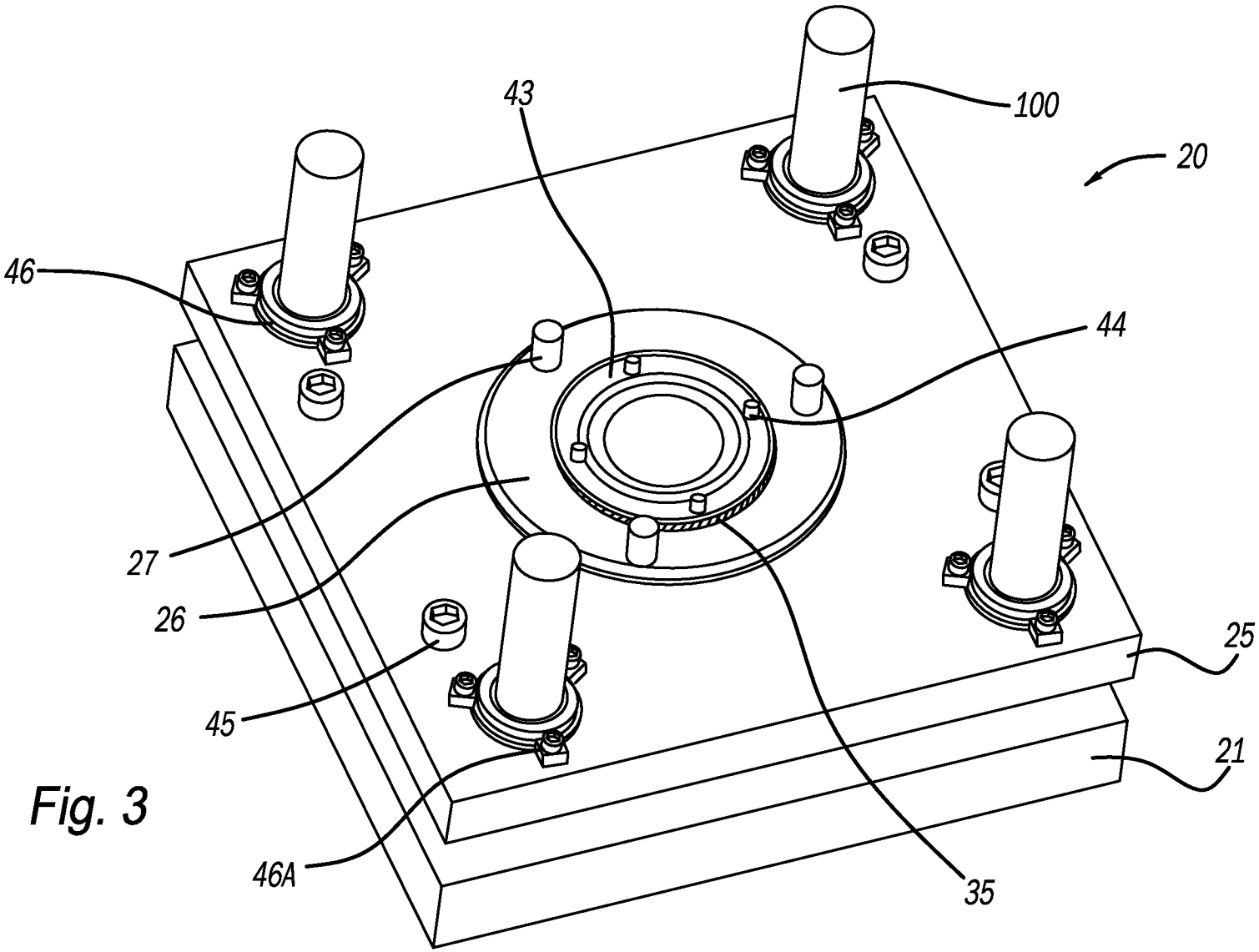
FIG. 3 is view from below of the upper portions of the press including the upper die shoe and drive plate in accordance with an aspect of the present disclosure.

Referring to FIG. 3, a view of the bottom of punch shoe with guide assembly 20 is shown in the same operational step as seen in FIG. 1. Guide posts 100 are fixed to upper die shoe 21 and passes through guide bushing 46 which can be adjusted to align drive plate 25 to upper die shoe 21 with the fasteners 46A surrounding the guide bushing 46. Fastener 45 is used to attach pad bottoming block 24 (hidden from view) to drive plate 25. Helical driver 26 is shown fixed and piloted within a locating diameter of drive plate 25. A trio of setup alignment dowels 27 are positioned equally around and fixed to helical driver 26. The upper helical mesh 35 can now be fully seen, where the inner helical spline feature of helical driver 26 engages the outer helical spline feature of helical driven pressing plate 43. The upper helical mesh 35 is the interface allowing relative rotation between helical driven pressing plate 43 and drive plate 25/helical driver 26 (which are fixed to each other). Drive pins 44 are shown installed into helical driven pressing plate 43.

Figure 4:
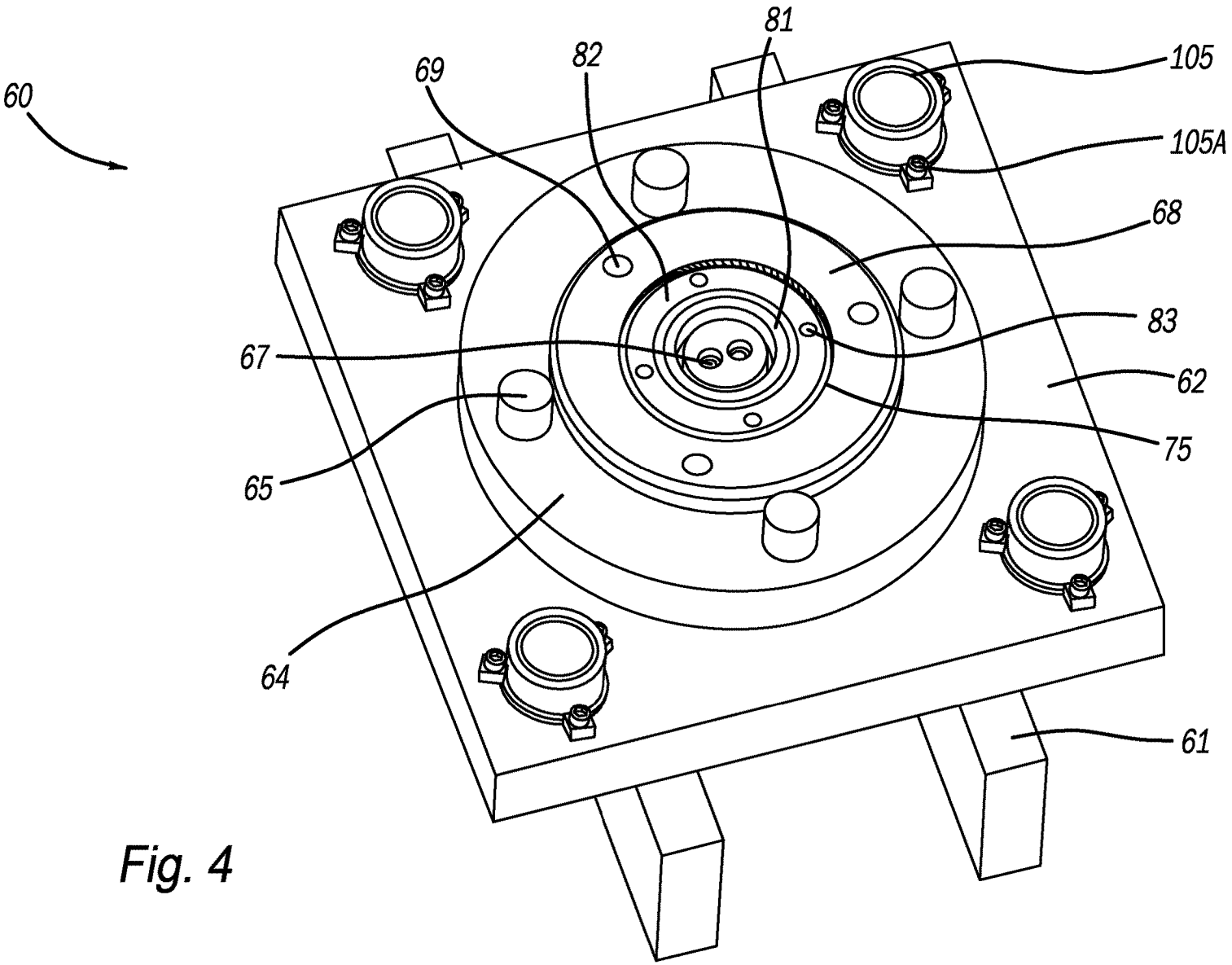
FIG. 4 is a view from above of the lower portions of the press including the lower die shoe, shown without the blank loaded, in accordance with an aspect of the present disclosure.

Referring to FIG. 4, a top view of the lower die shoe assembly 60 is shown in the same operational step as FIG. 1. Guide posts 100 will pass through lower guide bushing 105 which can be adjusted to align the lower die shoe assembly 60 with the punch shoe with guides assembly 20. Once aligned, lower guide bushing 105 is fixed to lower die shoe 62 and fastened with fasteners 105A. Base plate 64 provides the basis for attachment and alignment of the helical spline forming die 68 as it is received in the base plate 64 diameter used to pilot the helical spline forming die 68. Around the face of the base plate 64, pad balancing blocks 65 are attached. Lower helical mesh 75 can be clearly seen between the inner diameter of helical spline forming die 68 and the outer spline 82A of helical lower pad 82. The lower helical mesh 75 is the interface allowing relative rotation between helical spline forming die 68 and helical lower pad 82. Drive pin bores 83 are positioned around the face of helical lower pad 82. Closer to the central axis, the lower bearing retainer 70, which is stationary relative to the rotating lower pressure pad 81 and helical lower pad 82, can be seen with fasteners 67 extending downward and attaching the lower bearing retainer 70 to inner base plate 63 (hidden from view), such that lower bearing retainer 70, inner base plate 63, and lower die shoe 62 are fixed.

Figure 5:
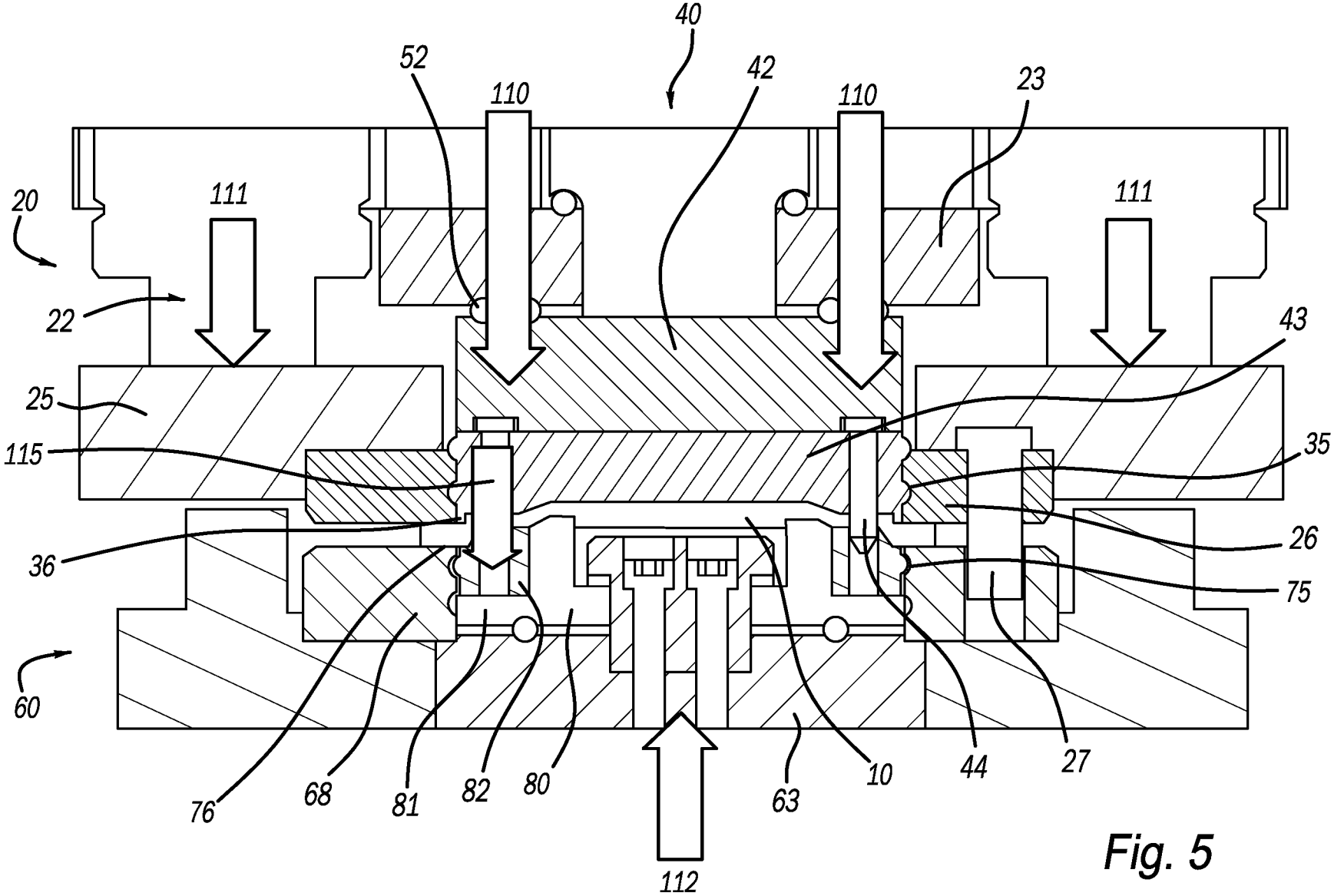
FIG. 5 is a detailed sectional view of the press of FIG. 1 when at a position where stamping of the blank begins.

Referring to FIG. 5, press assembly 5 is now in the operational position just prior to beginning stamping the helical outer diameter feature to blank 10. The punch shoe with guide assembly 20 has been brought down towards the lower die shoe assembly 60. The lower rotating tooling assembly 80 and lower helical mesh 75 is in its upper most position, where helical lower pad 82 may be rotated relative to helical spline forming die 68 at interface point 76. At this position blank 10 is fully supported across the helical lower pad 82 and helical spline forming die 68. The upper rotating tooling assembly 40 at this operational position begins to contact blank 10 upper surface with the bottom surface of helical driven pressing plate 43. In this embodiment drive pins 44 are shown passing through blank 10 via aperture 13 and engaging the drive pin bore 83 of helical lower pad 42. This is to rotationally connect the upper rotating assembly 40 with the lower rotating assembly 80 as required in further operational steps. Alternatives to creating a connection between the upper rotating assembly 40 and the lower rotating assembly 80 could also be mechanical gripping features, pressure contact, or other lug features on blank 10 to achieve the same result of rotationally connecting each assembly and allowing helical driven pressing plate 43 to impart a rotation on blank 10 and the lower rotating tooling assembly components 80. Upper rotating tooling assembly 40 is positioned so that there is a starting interface point 36 of upper helical mesh 35 where helical driven pressing plate 43 has not begun to form any feature into blank 10.

Continuing to refer to FIG. 5, now that the various press assemblies previously discussed are in position, a coordinated and timed stamping operation on blank 10 begins. Three overall forces within press assembly 5 are utilized to stamp blank 10. The main press force 110, either supplied mechanically or hydraulically, is the majority of the force utilized to shear blank 10 across thickness 16 to form the outer helical diameter 11. With the application of main press force 110 and movement of the upper die shoe 21 downwards, the upper gas springs 22 build pressure and apply a vertical force from pistons 22A directly to drive plate 25 and through the previously described connective nature into helical driver 26. This vertical force of helical driver 26 is exerted, through upper helical mesh 35, into helical driven pressing plate 43. As there is an angularity to upper helical mesh 35 tooth form, a force applied vertically from helical driver 26 translates to a rotational indexing motion of helical driven pressing plate 43. This results in the helical driven pressing plate 43 to extend downwards relative to interface point 36 and the helical driver 26, pressing into the blank 10. As previously described, drive pins 44 (or alternatively other torque transferring mechanisms) rotationally connect the upper rotating tooling assembly 40 with the lower rotating tooling assembly 80. Therefore, rotational motion of the helical driven pressing plate 43 will result in an equal rotation of the helical lower pad 82. The forces developed by the upper gas spring 22 are not solely sufficient in shearing blank 10 due to the thickness 16 and strength of the material utilized and only used, in conjunction with the upper helical mesh 35, to impart a rotational motion on the rotating assemblies 40 and 80. The lower gas spring 66, due to its continual contact with inner base plate 63, provides a controlled reactive upward force on the connected press components to support blank 10.

Still referring to FIG. 5, the force transfer of main press force 110 will be described. Main press force 110 will be applied in conjunction with the upper gas spring force 22 developed by compression of upper gas spring piston 22A. Press force 110 will be applied directly to upper die shoe 21, into upper bearing plate 23, through bearing 52, into lower bearing plate 42, transferring into helical driven pressing plate 43. A comparably small, additional force component 111 is also acting on helical driven pressing plate 43 due to the force from a compression of upper gas spring piston 22A onto the drive plate 25 and the helical driver 26, translating through the upper helical mesh 35 this downward vertical component of force. This combined force 115 is partially counter acted by lower gas spring force 112 due to the displacement of lower gas spring piston 66A. As stamping of blank 10 occurs, the upper rotating tooling assembly 40 and the lower rotating tooling assembly 80 will rotate equivalent to the designed helix angle 15 of the final part 12. This rotation is relatively small based on helix angle 15 and could also be considered indexing motion. The rotating tooling assemblies 40 and 80 will travel downward vertically based on helix angle 15 and blank thickness 16. Helical driven pressing plate 43 will travel beyond interface point 36, resulting in the bottom surface of helical driven pressing plate 43 being positioned below, or extended away from, the bottom surface of helical driver 26. Similarly, helical lower pad 82 will rotate resulting in a downward position relative to its starting point at interface point 76 between the helical lower pad 82 and helical spline forming die 68. During full travel, the cutting edge 43B of helical driven pressing plate 43 will pass helical spline forming die edge 68B to provide a clean break across entire thickness 16. It is an advantage to utilize the tooling components of helical driver 26, helical driven pressing plate 43 and helical spline forming die 68 with same helical features as final part 12 instead of providing an externally rotating input, such as an electric motor driving rotating assemblies 40 and 80 or other mechanically driven linkages, as the timing of applying forces to stamp teeth 11 while ensuring the correct helix angle 15 would be very difficult. These external rotating inputs would also add cost and complexity to the process.

Figure 6:
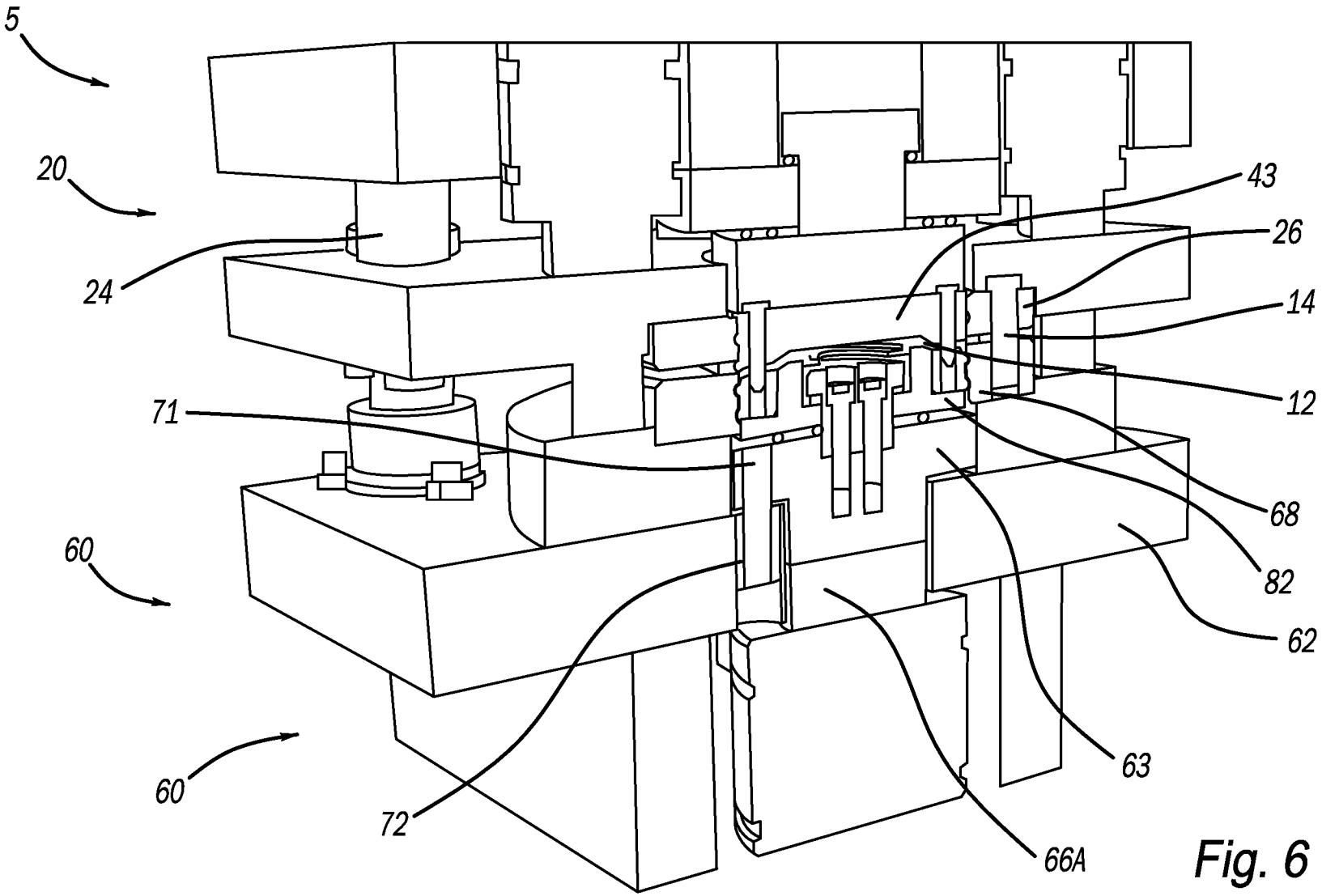
FIG. 6 is an isometric sectional view of the press of FIG. 1 when at the full travel position.

Referring to FIG. 6, an isometric sectional view of press assembly 5 is shown in a fully traveled position at the end of forming final part 12 from blank 10. Of particular interest in this view is anti-rotation dowel 71 which is fixed in position to the inner base plate 63. A bushing 72 is fixed to a bore within lower die shoe 62. Anti-rotation dowel 71 inserts into bushing 72 to ensure no rotation occurs between the inner base plate 63 and lower die shoe 62. As lower rotating components 60 and gas spring piston 66A travel vertically, anti-rotation dowel 71 will remain in engagement with bushing 72 and lower die shoe 62 providing a reactive rotational moment to the rotating components 60 and support bearings 91 and 92.

Figure 7:
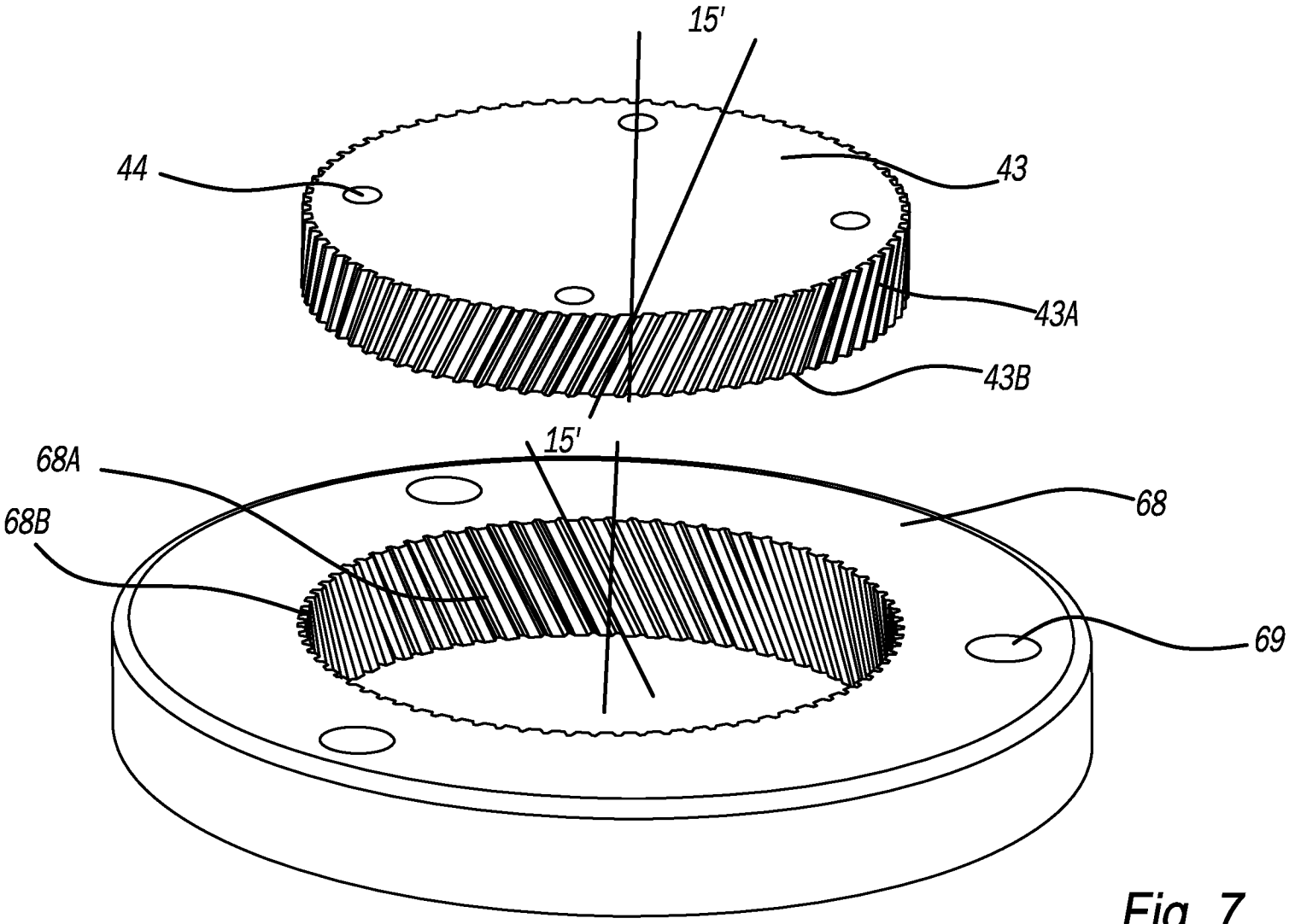
FIG. 7 is a detailed view of the helical driven pressing plate and helical spline forming die of the present disclosure.

Referring to FIG. 7, a view of the helical driven pressing plate 43 and helical spline forming die 68 are shown in a position as seen in the same operational step as FIG. 1. Blank 10, not shown, would be positioned therebetween. Final part 12 will have a design helical angle 15, while helical spline feature 43A and 68A will have the same corresponding angle 15'. This ensures the stamping process produces a final part 12 with the correct and accurate geometry. Helical driven pressing plate 43 will rotate and engage into helical spline forming die 68 while stamping a helical spline of the same design features (i.e. helical angle, minor and major outer diameters) as the final part 12 using the outer helical spline feature 43A of helical driven pressing plate 43. Cutting edge 43B will be pressed into, therefore shearing blank 10 against edge 68B during the downward rotating travel. Cutting edge 43B can be a sharp edge or a radiused edge depending on the result of the stamping procedure. The overall travel of cutting edge 43B relative to 68B will be sufficient to ensure the complete thickness 16 of blank 10 is formed, slightly entering the internal diameter 68B and past edge 68B completing the stamping or shearing of material from the blank 10. Diametrical clearances between helical spline tooling feature 68A and 43A can be adjusted to ensure a clean shear with minimal burnish, fracture, and rollover characteristics on the helical spline tooth 11 of final part 12.

Figure 8:
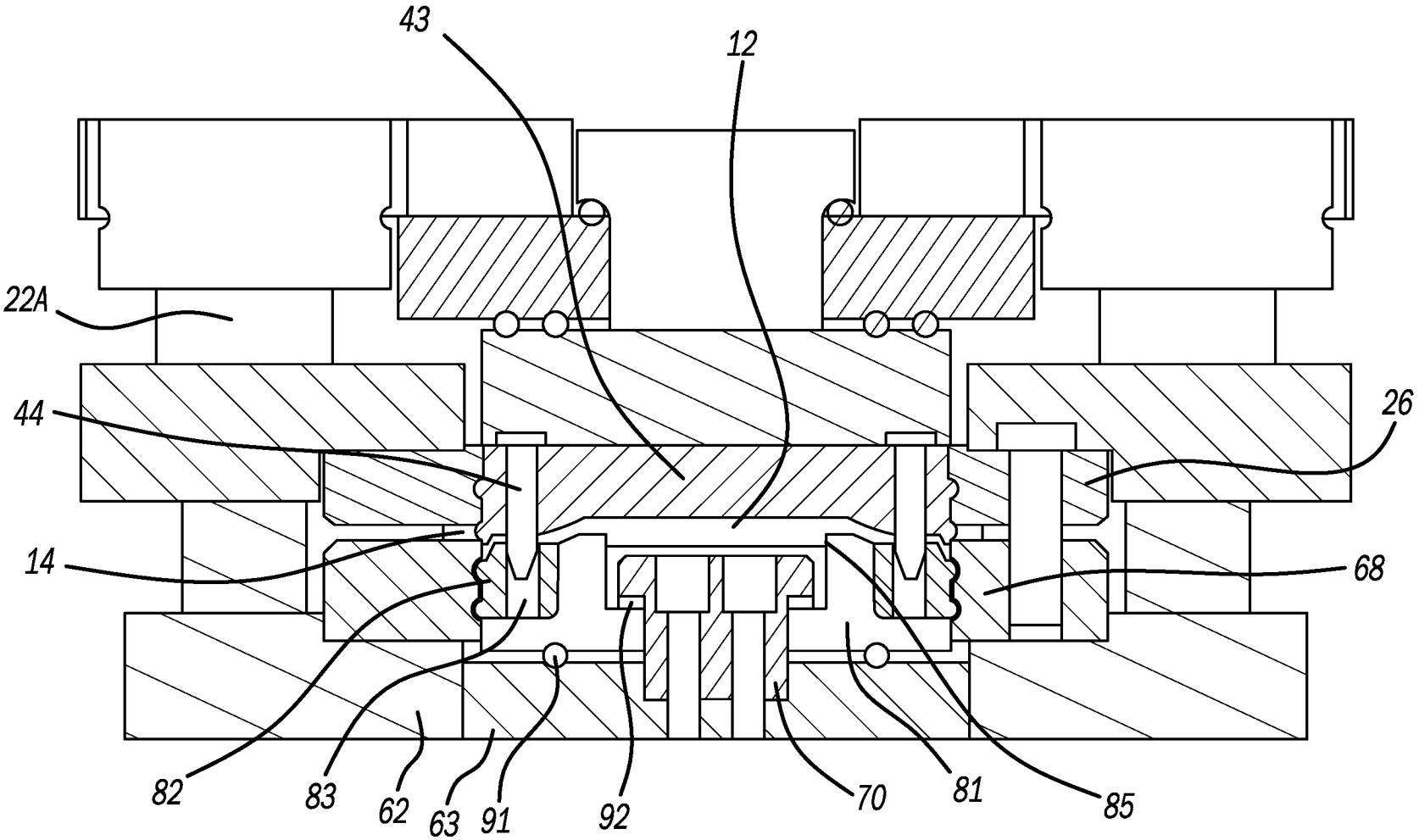
FIG. 8 is a detailed sectional view of the press of FIG. 1 when at the full travel position.
Figure 9:
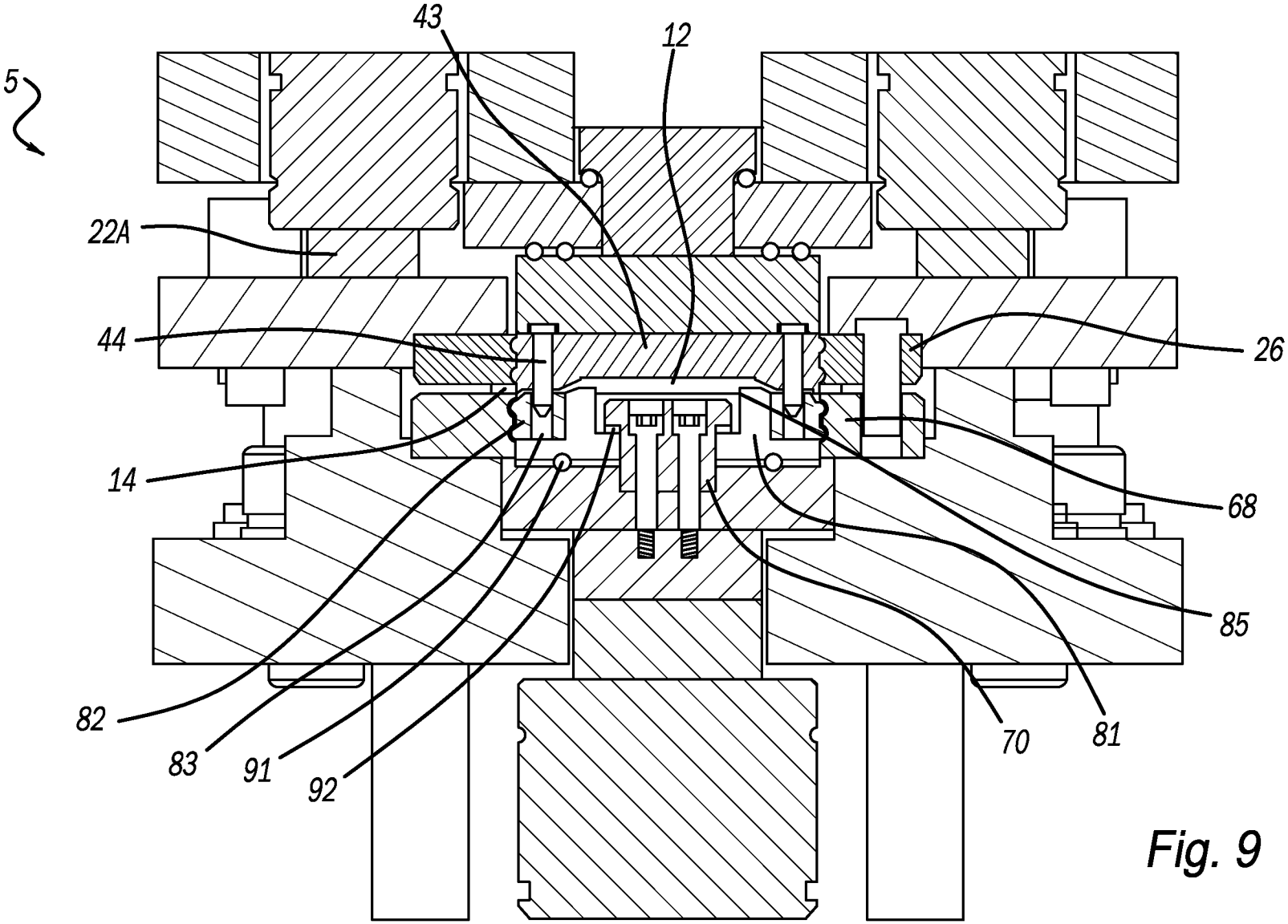
FIG. 9 is an overall view of the press of FIG. 1 when at the full travel position.

Referring to FIG. 8, a detailed sectional view of press 5 in its position at full travel is shown. At this point upper gas spring piston 22A is compressed against the drive plate 25 due to the decreased distance between the upper die shoe 21 and the drive plate 25. Lower gas spring piston (not shown) is pushed downward as the upper and lower rotating tooling assemblies 40 and 80 have reached their full rotation downward based on helix angle 15. Helical driven pressing plate 43 has entered into helical spline forming die 68 traveling fully across thickness 16 to stamp the helical spline teeth 11 forming final part 12 from blank 10. Outer diameter trim scrap 14 can now be seen squeezed between the helical driver 26 and helical spline forming die 68. At this point press force 110 is reduced. Lower gas spring force 112 results in force applied to the lower pressure pad 82, resulting in the pressure pad rotating now in a reversed rotation and traveling vertically upwards due to the lower helical mesh 75, similar to how the helical driver 26 drove the helical driven pressing plate 43 prior to forming final part 12. The reverse rotation of the lower rotating assembly 80, plus final part 12 rotating out of the inner diameter of the helical spline forming die 68, also drives a reversed rotation into the upper rotating tooling assembly 40 due to drive pins 44. At the position where the helical spline forming die 68 and the helical lower pad 82 have returned to interface point 76 (and corresponding interface point 36 for helical driver 26 and helical driven pressing plate 43), the press can further open where punch shoe with guide assembly 20 and the upper rotating tooling assembly 40 can be retracted. This allows final part 12 to be removed and the outer diameter trim scrap 14 to be discarded. At this point a new blank 10 can be reloaded and the process can repeat.

The foregoing description of the embodiments has been provided for purposes of illustration and description. It is not intended to be exhaustive or to limit the disclosure. Individual elements or features of a particular embodiment are generally not limited to that particular embodiment, but, where applicable, are interchangeable and can be used in a selected embodiment, even if not specifically shown or described. The same may also be varies in many ways. Such variations are not to be regarded as a departure from the disclosure, and all such modifications are intended to be included within the scope of disclosure.

What is claimed:

1. A method for forming an external helical spline feature on a gear blank, the method comprising the steps of:

providing a lower die shoe assembly configured to receive the gear blank having an unfinished condition, the lower die shoe assembly including a lower stationary portion and a lower rotatable portion rotatable relative to the lower stationary portion;

providing an upper punch shoe assembly configured to move relative toward the lower die shoe assembly, the upper punch shoe assembly including an upper stationary portion and an upper rotatable portion rotatable relative to the upper stationary portion;

providing the gear blank between the upper punch shoe assembly and lower die shoe assembly and supporting the gear blank on the lower die shoe assembly;

bringing the upper punch shoe assembly into contact with the gear blank;

driving the upper rotatable portion downward relative to the upper stationary portion and rotating the upper rotatable portion relative to the upper stationary portion;

driving the gear blank downward into to the lower stationary portion and rotating the gear blank relative to the lower stationary portion; and in response thereto, forming an external helical spline on the gear blank with the lower stationary portion.

2. The method of claim 1, wherein an upper helical mesh is defined between the upper stationary portion and the upper rotatable portion and a lower helical mesh is defined between the lower stationary portion and the lower rotatable portion, wherein an angle of the upper and lower helical mesh is the same.

3. The method of claim 2, wherein an angle of the external helical spline matches the angle of the upper and lower helical mesh.

4. The method of claim 2, wherein the upper rotatable portion includes external toothing, wherein the external toothing is received with internal toothing of the lower stationary portion when the upper rotatable portion is driven downward.

5. The method of claim 1, wherein the upper rotatable portion engages the lower rotatable portion such that the upper rotatable portion and lower rotatable portion rotate together.

6. The method of claim 5, wherein the upper stationary portion includes at least one alignment dowel extending therefrom, wherein the at least one alignment dowel is received in a corresponding alignment bore formed in the lower stationary portion.

7. The method of claim 5, wherein the upper rotatable portion includes at least one drive pin extending downwardly therefrom, wherein the at least one drive pin is received in a corresponding drive pin bore of the lower rotatable portion.

8. The method of claim 7, wherein the gear blank includes at least one aperture extending therethrough, wherein the at least one drive pin passes through the at least one aperture.

9. The method of claim 1 further comprising fixing rotation of the upper rotatable portion to the lower rotatable portion prior to driving the gear blank downward.

10. The method of claim 1 further comprising applying a downward press force on the upper rotatable portion and the upper stationary portion, wherein an upper helical mesh indexes the upper rotatable portion relative to the upper stationary portion to causes relative vertical and rotational movement between the upper rotatable portion and the upper stationary portion.

11. The method of claim 10 further comprising counteracting the downward press force with an upwardly directed spring force applied to the lower rotatable portion.

12. The method of claim 10, wherein the downwardly press force is applied to the upper stationary portion, through a bearing disposed between the upper stationary portion and the upper rotatable portion, and into the upper rotatable portion.

13. The method of claim 1, wherein the upper stationary portion includes a first upper bearing plate and the upper rotatable portion includes a helical driven pressing plate, wherein a first lower bearing is disposed vertically between the helical driven pressing plate and the first upper bearing plate.

14. The method of claim 13, wherein the upper rotatable portion further includes an upper bearing retainer and a first lower bearing plate, wherein the first lower bearing plate is fixed to the helical driven pressing plate and disposed between the first upper bearing plate and the helical driven pressing plate, a first upper bearing is disposed vertically between the upper bearing retainer and the first upper bearing plate, and the first lower bearing is disposed vertically between the first upper bearing plate and the first lower bearing plate.

15. The method of claim 1, wherein the upper stationary portion includes a helical driver having first internal threads, and the upper rotatable portion includes a helical driven pressing plate having first external threads, wherein the first internal and first external threads engage to define a upper helical mesh; and wherein the lower stationary portion includes a helical spline forming die having second internal threads, and the lower rotatable portion includes a helical lower pad, wherein the second internal and second external threads engage to define a lower helical mesh.

16. A press assembly for defining external helical threads on a gear blank, the press assembly comprising:

a lower die shoe assembly configured to receive the gear blank having an unfinished condition, the lower die shoe assembly including a lower stationary portion and a lower rotatable portion rotatable relative to the lower stationary portion;

an upper punch shoe assembly configured to move relative toward the lower die shoe assembly, the upper punch shoe assembly including an upper stationary portion and an upper rotatable portion rotatable relative to the lower stationary portion, wherein the upper punch shoe assembly is configured to engage the gear blank and shape the gear blank in combination with the lower die assembly;

wherein the upper rotatable portion and lower rotatable portion are configured to engage each other in fixed relation for conjoint rotation; and wherein the upper rotatable portion and lower rotatable portion are moveable downward relative to the upper and lower stationary portions, wherein the relative downward movement causes the conjoint rotation;

wherein the upper stationary portion includes a helical driver having first internal threads, and the upper rotatable portion includes a helical driven pressing plate having first external threads, wherein the first internal and first external threads engage to define an upper helical mesh;

wherein the lower stationary portion includes a helical spline forming die having second internal threads, and the lower rotatable portion includes a helical lower pad having second external threads, wherein the second internal and second external threads engage to define a lower helical mesh; and wherein the upper and lower helical mesh have the same angle.

17. The press assembly of claim 16, wherein the upper rotatable portion includes at least one drive pin extending therefrom, wherein the lower rotatable portion includes at least one drive pin bore corresponding to the at least one drive pin, wherein the drive pin bore receives the drive pin in response to downward movement of the upper rotatable portion to fix the upper and lower rotatable portion for conjoint rotation.

18. The press assembly of claim 16, wherein the helical drive pressing plate is moveable into the helical spline forming die.

19. The press assembly of claim 16, wherein the upper stationary portion includes a first upper bearing plate;

wherein the upper rotatable portion further includes an upper bearing retainer and a first lower bearing plate, wherein the first upper bearing plate is disposed between the upper bearing retainer and the first lower bearing plate;

wherein the upper rotatable portion includes a helical driven pressing plate fixed to the first lower bearing plate, and the first lower bearing plate is disposed between the first lower bearing plate and the helical driven pressing plate;

wherein a first lower bearing is disposed vertically between the first upper bearing plate and the first lower bearing plate and a first upper bearing is disposed between the upper bearing retainer and the first upper bearing plate;

wherein the lower rotatable portion includes a helical lower pad fixed to a lower pressure pad;

wherein the stationary portion includes a lower bearing retainer fixed to an inner base plate; and wherein a second upper bearing is disposed between the lower bearing retainer and the lower pressure pad, and a second lower bearing is disposed between the lower pressure pad and the inner base plate.

20. A press assembly for defining external helical threads on a gear blank, the press assembly comprising:

a lower die shoe assembly configured to receive the gear blank having an unfinished condition, the lower die shoe assembly including a lower stationary portion and a lower rotatable portion rotatable relative to the lower stationary portion;

an upper punch shoe assembly configured to move relative toward the lower die shoe assembly, the upper punch shoe assembly including an upper stationary portion and an upper rotatable portion rotatable relative to the lower stationary portion, wherein the upper punch shoe assembly is configured to engage the gear blank and shape the gear blank in combination with the lower die assembly;

wherein the upper rotatable portion and lower rotatable portion are configured to engage each other in fixed relation for conjoint rotation; and wherein the upper rotatable portion and lower rotatable portion are moveable downward relative to the upper and lower stationary portions, wherein the relative downward movement causes the conjoint rotation;

wherein the upper rotatable portion includes at least one drive pin extending therefrom, wherein the lower rotatable portion includes at least one drive pin bore corresponding to the at least one drive pin, wherein the drive pin bore receives the drive pin in response to downward movement of the upper rotatable portion to fix the upper and lower rotatable portion for conjoint rotation.

* * * * *